US008876987B2

(12) United States Patent
Matsuda et al.

(10) Patent No.: US 8,876,987 B2
(45) Date of Patent: Nov. 4, 2014

(54) HIGH-STRENGTH STEEL SHEET AND METHOD FOR MANUFACTURING SAME

(71) Applicant: JFE Steel Corporation, Tokyo (JP)

(72) Inventors: Hiroshi Matsuda, Tokyo (JP); Yoshimasa Funakawa, Tokyo (JP); Kaneharu Okuda, Tokyo (JP); Kazuhiro Seto, Tokyo (JP)

(73) Assignee: JFE Steel Corporation (JP)

( * ) Notice: Subject to any disclaimer, the term of this patent is extended or adjusted under 35 U.S.C. 154(b) by 0 days.

(21) Appl. No.: 14/349,234

(22) PCT Filed: Oct. 2, 2012

(86) PCT No.: PCT/JP2012/006306

§ 371 (c)(1), (2), (4) Date: Apr. 2, 2014

(87) PCT Pub. No.: WO2013/051238

PCT Pub. Date: Apr. 11, 2013

(65) Prior Publication Data

US 2014/0242416 A1 Aug. 28, 2014

(30) Foreign Application Priority Data

Oct. 4, 2011 (JP) ..... 2011-220495

(51) Int. Cl.

| | |
|---|---|
| ***C22C 38/04*** | (2006.01) |
| ***C22C 38/06*** | (2006.01) |
| ***C22C 38/02*** | (2006.01) |
| ***C21D 8/02*** | (2006.01) |
| ***C22C 38/00*** | (2006.01) |
| ***C22C 38/12*** | (2006.01) |
| ***C22C 38/14*** | (2006.01) |
| ***C23C 2/02*** | (2006.01) |
| ***C22C 38/28*** | (2006.01) |
| ***C22C 38/38*** | (2006.01) |
| ***C22C 38/32*** | (2006.01) |
| ***C22C 38/16*** | (2006.01) |
| ***C22C 38/08*** | (2006.01) |

(52) U.S. Cl.

CPC ..... *C23C 2/02* (2013.01); *C21D 8/0263* (2013.01); *C22C 38/06* (2013.01); *C22C 38/001* (2013.01); *C22C 38/12* (2013.01); *C22C 38/14* (2013.01); *C22C 38/28* (2013.01); *C22C 38/38* (2013.01); *C22C 38/32* (2013.01); *C22C 38/005* (2013.01); *C22C 38/16* (2013.01); *C22C 38/02* (2013.01); *C22C 38/002* (2013.01); *C22C 38/08* (2013.01); *C22C 38/04* (2013.01); *Y10S 148/909* (2013.01)

USPC ..... 148/320; 148/330; 148/331; 148/332; 148/334; 148/335; 148/336; 148/909; 148/602; 148/603; 148/651; 148/653

(58) Field of Classification Search

None

See application file for complete search history.

(56) References Cited

U.S. PATENT DOCUMENTS

| | | | | |
|---|---|---|---|---|
| 2008/0000555 | A1* | 1/2008 | Nonaka et al. | 148/328 |
| 2011/0008647 | A1* | 1/2011 | Azuma et al. | 428/659 |
| 2011/0146852 | A1* | 6/2011 | Matsuda et al. | 148/533 |
| 2011/0162762 | A1* | 7/2011 | Matsuda et al. | 148/533 |
| 2013/0048161 | A1* | 2/2013 | Matsuda et al. | 148/653 |
| 2013/0133786 | A1* | 5/2013 | Matsuda et al. | 148/533 |
| 2014/0096876 | A1* | 4/2014 | Matsuda et al. | 148/653 |

FOREIGN PATENT DOCUMENTS

| | | |
|---|---|---|
| JP | 4-235253 | 8/1992 |
| JP | 11-256273 | 9/1999 |
| JP | 2004-76114 | 3/2004 |
| JP | 2005-200694 | 7/2005 |
| JP | 2006-104532 | 4/2006 |
| JP | 2010-090475 | 4/2010 |
| JP | 2011-184756 | 9/2011 |

OTHER PUBLICATIONS

Japanese Notice of Reasons for Rejection along with English Translation issued in corresponding. JP Application No. 2013-526023. Sep. 10, 2013.

* cited by examiner

*Primary Examiner* — Deborah Yee

(74) *Attorney, Agent, or Firm* — DLA Piper LLP (US)

(57) ABSTRACT

A high strength pressed member has excellent ductility and stretch flangeability and tensile strength of 780-1400 MPa, with a predetermined steel composition and steel microstructure relative to the entire microstructure of steel sheet, where area ratio of martensite 5-70%, area ratio of retained austenite 5-40%, area ratio of bainitic ferrite in upper bainite 5% or more, and total thereof is 40% or more, 25% or more of martensite is tempered martensite, polygonal ferrite area ratio is above 10% and below 50% to the entire microstructure of steel sheet, and average grain size is 8 μm or less, average diameter of a group of polygonal ferrite grains is 15 μm or less, the group of polygonal ferrite grains represented by a group of ferrite grains of adjacent polygonal ferrite grains, and average carbon content in retained austenite is 0.70 mass % or more and tensile strength is 780 MPa or more.

20 Claims, No Drawings

HIGH-STRENGTH STEEL SHEET AND METHOD FOR MANUFACTURING SAME

TECHNICAL FIELD

This disclosure relates to a high strength steel sheet used in the industrial fields of automobiles, electric appliances and so on, having excellent formability, especially excellent ductility and stretch flangeability, and having a tensile strength (TS) of 780 MPa or more and 1400 MPa or less, and a method of manufacturing the same.

BACKGROUND

In recent years, enhancement of fuel efficiency of automobiles has become an important issue from the viewpoint of global environment protection. Consequently, there is an active movement to reduce the thickness of vehicle body components through increases in strength of vehicle body materials, and thereby reduce the weight of the vehicle body itself.

In general, to strengthen a steel sheet, it is necessary to raise the proportion of a hard phase such as martensite or bainite relative to the entire microstructure of the steel sheet. However, strengthening a steel sheet by raising the proportion of a hard phase leads to degradation in formability. Therefore, it has been desired to develop a steel sheet that has both high strength and excellent formability. To date, various multi-phase steel sheets have been developed such as ferrite-martensite dual phase steel (DP steel) or TRIP steel utilizing transformation-induced plasticity of retained austenite.

If the proportion of hard phase is raised in a multi-phase steel sheet, the formability of the steel sheet will be strongly affected by the workability of the hard phase. This is because if the proportion of the hard phase is low and there is a large amount of soft polygonal ferrite, then deformability of the polygonal ferrite will be dominant over formability of the steel sheet. Therefore, formability of the steel sheet such as ductility can be ensured even if workability of the hard phase is not enough. On the other hand, if the proportion of hard phase is high, deformability of the hard phase itself, rather than deformability of the polygonal ferrite directly affects the formability of the steel sheet.

Thus, in the case of a cold-rolled steel sheet, it is subjected to heat treatment to control the amount of polygonal ferrite generated during annealing and subsequent quenching processes. The steel sheet is then subjected to water quenching to generate martensite, which is tempered by reheating and retaining the steel sheet at a high temperature so that carbides are generated in the martensite of hard phase to improve workability of the martensite. However, such quenching and tempering of the martensite require special production facilities such as, e.g., continuous annealing facilities with the ability of water quenching. Accordingly, in normal production facilities without the ability of subjecting a steel sheet to water quenching and then reheating and retaining it at high temperature, it is indeed possible to strengthen the steel sheet, but it is not possible to improve the workability of martensite as the hard phase.

In addition, as an example of a steel sheet having a hard phase other than martensite, there is a steel sheet in which a primary phase is polygonal ferrite and a hard phase is bainite and pearlite, and carbides are generated in such bainite and pearlite serving as the hard phase. This steel sheet exhibits improved workability not only by polygonal ferrite, but also by generating carbides in the hard phase to improve workability of the hard phase in itself, where, in particular, an improvement of the stretch-flangeability is intended. However, since the primary phase is polygonal ferrite, it is difficult to achieve both an increase in strength to 780 MPa or more in terms of tensile strength (TS) and formability. In this connection, even when workability of the hard phase itself is improved by generating carbides in the hard phase, the level of workability is inferior to that of polygonal ferrite. Therefore, if the amount of polygonal ferrite is reduced to increase the strength to 780 MPa or more in terms of tensile strength (TS), adequate formability cannot be obtained.

To address the above-described problem, for example, JP 4-235253 A proposes a high strength steel sheet having excellent bendability and impact properties, wherein alloy components are specified and the steel microstructure is fine uniform bainite including retained austenite.

JP 2004-076114 A proposes a multi-phase steel sheet having excellent bake hardenability, wherein predetermined alloy components are specified, the steel microstructure is bainite including retained austenite, and the amount of retained austenite in the bainite is specified.

JP 11-256273 A discloses a multi-phase steel sheet having excellent impact resistance, wherein predetermined alloy components are specified, the steel microstructure is specified such that bainite including retained austenite is 90% or more in terms of area ratio and the amount of austenite in the bainite is 1% or more and 15% or less, and the hardness (HV) of the bainite is specified.

JP 2010-090475 A proposes a high strength steel sheet having excellent formability, wherein a predetermined alloy composition and a predetermined steel microstructure are specified, adequate strength is ensured by a martensite phase, stable retained austenite is ensured by upper bainite transformation and, furthermore, a part of the martensite phase is tempered martensite.

Hereafter, an important challenge to achieve even wider application of high strength steel sheets, in particular, steel sheets in 780 MPa grade or higher of strength, is how to improve ductility and/or bendability when enhancing the strength of steel sheets, while preserving the absolute value of stretch flangeability. Relating to this problem, however, the above-mentioned steel sheets are facing the following problem.

That is, the steel disclosed in JP 4-235253 A indeed has excellent bendability, but in most cases does not provide sufficient stretch flangeability, which limits its application range.

In addition, while the steels disclosed in JP 2004-076114 A and JP 11-256273 A have excellent impact absorption ability, no consideration is given to stretch flangeability at all, which limits the application of these steels to those parts requiring stretch flangeability during forming, and as a result, these steels are applicable in a limited range.

The steel sheet disclosed in JP 2010-090475 A addresses the above-described problem by using the microstructure of steel without ferrite. That steel sheet has excellent stretch flangeability and ductility depending on the strength level, in particular, when it is required to have a strength of 1400 MPa or more. However, it cannot be said that that steel sheet ensures sufficiently high stretch flangeability required for the material at the strength level of less than 1400 MPa, which also limits the application of this steel sheet.

It could therefore be helpful to provide a high strength steel sheet having excellent formability, in particular, ductility and stretch flangeability, and having a tensile strength (TS) of 780 MPa or more, and an advantageous method of manufacturing the same.

It should be noted that examples of high strength steel sheets include steel sheets in which hot-dip galvanizing or galvannealing is applied to a surface of the steel sheet.

In addition, as used herein, the term "excellent formability" indicates that the following conditions are met: λ value, which is an index of stretch flangeability, is 25% or more regardless of the strength of the steel sheet, and a product of TS (tensile strength) and T.EL (total elongation), or the value of TS×T.EL is 27000 MPa·% or more.

SUMMARY

We found that at a strength level where the tensile strength is 780 to 1400 MPa, it is easier to improve ductility and maintain the required stretch flangeability of such a steel sample that contains a certain amount of polygonal ferrite combined with tempered martensite and a hard phase of upper bainite containing retained austenite than that of a steel sample composed of a combination of only tempered martensite and a hard phase of upper bainite containing retained austenite and, therefore, it is possible to significantly increase the applicable range of the former steel sample.

Specifically, we found that to provide a high strength steel sheet that is mainly composed of hard phases, contains a predetermined polygonal ferrite and is provided with a multi-phase of hard phases, the strength of a steel sheet was enhanced through the use of a martensite phase, sufficient stable retained austenite advantageous to obtain a TRIP effect was ensured through the use of upper bainite transformation, and a portion of the martensite was converted to tempered martensite, whereby such a high strength steel sheet was obtained that has excellent formability, in particular well balances strength and ductility and ensures sufficient stretch-flangeability, and that has a tensile strength of 780 MPa or more and 1400 MPa or less.

We studied the relationship between the tempered condition of martensite and the retained austenite, in particular, focusing on the arrangement of hard phases when providing a multi-phase of ferrite and hard phases. We found that it is possible to further improve ductility of a steel sheet in terms of balancing ductility and stretch flangeability at the time of enhancing the strength of the steel sheet by controlling Ms and the degree of undercooling from that Ms when the steel sheet is cooled to the following temperature range to partially generate martensite prior to stabilization of retained austenite by bainite transformation: martensite transformation start temperature=Ms or lower, and martensite transformation finish temperature=Mf or higher.

Although the reasons are not clear, we believe that this is because when martensite is generated with Ms and the degree of undercooling from that Ms optimally controlled, stabilization of retained austenite is facilitated by compressive stress applied to non-transformed austenite due to tempering of martensite and martensite transformation in the temperature range in which bainite is generated by subsequent heating and retaining at high temperature.

We thus provide:

[1] A high strength steel sheet comprising a chemical composition including, in mass %, C: 0.10% or more and 0.59% or less, Si: 3.0% or less, Mn: 0.5% or more and 3.0% or less, P: 0.1% or less, S: 0.07% or less, Al: 3.0% or less, N: 0.010% or less, and the balance being Fe and incidental impurities, wherein a relation [Si %]+[Al %]=0.7% or more is satisfied (where [X %] indicates mass % of element X), wherein the steel sheet has a microstructure such that:

martensite has an area ratio of 5% or more and 70% or less to the entire microstructure of the steel sheet, retained austenite is contained in an amount of 5% or more and 40% or less, and bainitic ferrite in upper bainite has an area ratio of 5% or more to the entire microstructure of the steel sheet, where a total of the area ratio of the martensite, the amount of the retained austenite and the area ratio of the bainitic ferrite is 40% or more, 25% or more of the martensite is tempered martensite, polygonal ferrite has an area ratio of more than 10% and less than 50% to the entire microstructure of the steel sheet and an average grain size of 8 μm or less, and an average diameter of a group of polygonal ferrite grains is 15 μm or less, where the group of polygonal ferrite grains is represented by a group of ferrite grains composed of adjacent polygonal ferrite grains, wherein an average carbon content in the retained austenite is 0.70 mass % or more, and wherein the steel sheet has a tensile strength of 780 MPa or more.

[2] The high strength steel sheet according to item [1] above, wherein the number of iron-based carbides, each having a size of 5 nm or more and 0.5 μm or less, precipitated in the tempered martensite is $5\times10^4$ or more per 1 $mm^2$.

[3] The high strength steel sheet according to item [1] or [2] above, wherein the steel sheet further comprises, in mass %, at least one element selected from Cr: 0.05% or more and 5.0% or less, V: 0.005% or more and 1.0% or less, and Mo: 0.005% or more and 0.5% or less.

[4] The high strength steel sheet according to any one of items [1] to [3] above, wherein the steel sheet further comprises, in mass %, at least one element selected from Ti: 0.01% or more and 0.1% or less, and Nb: 0.01% or more and 0.1% or less.

[5] The high strength steel sheet according to any one of items [1] to [4] above, wherein the steel sheet further comprises, in mass %, B: 0.0003% or more and 0.0050% or less.

[6] The high strength steel sheet according to any one of items [1] to [5] above, wherein the steel sheet further comprises, in mass %, at least one element selected from Ni: 0.05% or more and 2.0% or less, and Cu: 0.05% or more and 2.0% or less.

[7] The high strength steel sheet according to any one of items [1] to [6] above, wherein the steel sheet further comprises, in mass %, at least one element selected from Ca: 0.001% or more and 0.005% or less, and REM: 0.001% or more and 0.005% or less.

[8] The high strength steel sheet according to any one of items [1] to [7] above, wherein the steel sheet has a hot-dip galvanized layer or a galvannealed layer on a surface thereof.

[9] A method of manufacturing a high strength steel sheet, the method comprising:

in hot rolling a billet with the chemical composition as recited in any one of items [1] to [7] above, finishing the hot rolling of the billet when a finisher delivery temperature reaches $Ar_3$ or higher;

then cooling the billet at a cooling rate until at least 720° C. of (1/[C %])° C./sec or higher (where [C %] indicates mass % of carbon);

then coiling the billet under a condition of a coiling temperature of 200° C. or higher and 720° C. or lower to obtain a hot-rolled steel sheet;

directly after the coiling, or optionally, after cold rolling the hot-rolled steel sheet to obtain a cold-rolled steel sheet, subjecting the hot-rolled steel sheet or the cold-rolled steel sheet to annealing for 15 seconds or more and 600 seconds or less in a ferrite-austenite dual phase region or in an austenite single phase region;

then cooling the steel sheet to a first temperature range of (Ms-150° C.) or higher to lower than Ms, where Ms is martensite transformation start temperature, at an average cooling rate of 8° C./sec or higher;

then heating the steel sheet to a second temperature range of 350° C. or higher to 490° C. or lower; and retaining the steel sheet in the second temperature range for 5 seconds or more to 2000 seconds or less.

[10] The method of manufacturing a high strength steel sheet according to item [9] above, wherein the coiling temperature is within a range of 580° C. or higher and 720° C. or lower.

[11] The method of manufacturing a high strength steel sheet according to item [9] above, wherein the coiling temperature is within a range of 360° C. or higher and 550° C. or lower.

[12] The method of manufacturing a high strength steel sheet according to any one of items [9] to [11], wherein after completion of the cooling of the steel sheet to at least the first temperature range, the steel sheet is subjected to a hot-dip galvanizing or galvannealing process.

A high strength steel sheet may be obtained that has excellent formability, among other things, ductility and stretch flangeability and, furthermore, a tensile strength (TS) of 780 to 1400 MPa. Therefore, the high strength steel sheet has very high industrial applicability in the fields of automobiles, electric appliances and so on, and in particular is extremely useful in reducing the weight of automobile bodies.

DETAILED DESCRIPTION

Our steel sheets and methods will be specifically described below.

Firstly, the reasons for the limitations of the microstructure of the steel sheets will be described. Unless otherwise specified herein, the term area ratio means an area ratio to the entire microstructure of the steel sheet.

<Area Ratio of Martensite: 5% or More and 70% or Less>

Martensite is a hard phase and necessary to strengthen a steel sheet. An area ratio of martensite less than 5% does not satisfy the condition, tensile strength (TS) of steel sheet=780 MPa. On the other hand, an area ratio of martensite exceeding 70% leads to reduced upper bainite, which is problematic because a sufficient amount of stable retained austenite with carbon concentrations cannot be obtained and workability such as ductility deteriorates. Accordingly, the area ratio of martensite is 5% or more and 70% or less, preferably 5% or more and 60% or less, more preferably 5% or more and 45% or less.

<Proportion of Tempered Martensite in Martensite: 25% or More>

If the proportion of tempered martensite in martensite to the entire martensite present in the steel sheet is less than 25%, the resulting steel sheet has a tensile strength of 780 MPa or more, but is inferior in terms of stretch flangeability. In contrast, if the proportion of the above-described tempered martensite is 25% or more, it is possible to improve deformability of martensite itself by tempering the as-quenched martensite, which is extremely hard and assumes low deformability, and thereby enhance workability, among other things, stretch flangeability, so that the λ value, which is an index of stretch flangeability, can be 25% or higher regardless of the strength of the steel sheet. In addition, there is a significantly large difference in hardness between the as-quenched martensite and the upper bainite. Thus, if there is a small amount of tempered martensite and a large amount of as-quenched martensite, there are more interfaces between the as-quenched martensite and the upper bainite, minute voids are formed in the interfaces between the as-quenched martensite and the upper bainite during punching and so on, and it is more likely that voids are combined together and cracks tend to grow during stretch flange forming subsequent to punching, which leads to further degradation in stretch flangeability.

Accordingly, the proportion of tempered martensite in martensite is 25% or more, preferably 35% or more, to the entire martensite present in the steel sheet. It should be noted that the tempered martensite is observed as such a phase with fine carbides precipitated in the martensite by SEM (Scanning Electron Microscope) observation or the like, and can be clearly distinguished from the as-quenched martensite where such carbides are not found in the martensite.

In addition, the upper limit of the proportion of the above-described martensite is 100%, preferably 80%.

<Amount of Retained Austenite: 5% or More and 40% or Less>

Retained austenite improves ductility by enhancing strain dispersibility through martensite transformation using the TRIP effect during working. The steel sheets utilize upper bainite transformation to allow retained austenite with increased carbon concentrations to be formed in the upper bainite. As a result, such retained austenite may be obtained that can show a TRIP effect during working even in a high strain range. By making use of the concurrent existence of such retained austenite and martensite, good formability may be obtained even in a high strength range where the tensile strength (hereinafter, referred to simply as "TS") is 780 MPa or more. Specifically, a product of TS and total elongation (hereinafter, referred to simply as "T.EL"), or TS×T.EL may be 27000 MPa·% or more, which results in a steel sheet with well-balanced strength and ductility.

It should be noted here that since the retained austenite is formed between laths of bainitic ferrite in the upper bainite and finely distributed in the upper bainite, to determine its quantity (area ratio) by microstructure observation requires a great deal of measurement at high magnification which makes it difficult to quantify the retained austenite precisely. However, the amount of the retained austenite formed between laths of bainitic ferrite is consistent, to some extent, with the amount of bainitic ferrite formed. In this respect, we found that a sufficient TRIP effect may be obtained and the following conditions can be met: tensile strength (TS)=780 MPa or more and TS×T.EL=27000 MPa·% or more, if the bainitic ferrite in the upper bainite has an area ratio of 5% or more, and if the amount of retained austenite, which is determined from strength measurements by X-ray diffraction (XRD) which is a technique conventionally used to measure the amount of retained austenite, specifically from the X-ray diffraction intensity ratio of ferrite and austenite, is 5% or more. We also ascertained that the amount of retained austenite determined by a conventional technique of measuring the amount of retained austenite has a value that is equivalent to an area ratio of the retained austenite to the entire microstructure of the steel sheet. In this case, if the amount of retained austenite is less than 5%, a sufficient TRIP effect cannot be obtained. On the other hand, if the amount of retained austenite exceeds 40%, an excessively large amount of hard martensite is produced after the onset of the TRIP effect, which is problematic in terms of degradation in toughness and so on. Accordingly, the amount of retained austenite is 5% or more and 40% or less, preferably more than 5% and 40% or less, more preferably 8% or more and 35% or less, even more preferably 10% or more and 30% or less.

<Average Carbon Content in Retained Austenite: 0.70% or More>

To obtain excellent formability by utilizing the TRIP effect, carbon (C) content in retained austenite is important for a high strength steel sheet in 780 to 1400 MPa grade of tensile strength (TS). The steel sheet allows concentration of carbon in the retained austenite formed between laths of bainitic ferrite in the upper bainite.

Although it is difficult to precisely assess the above-described carbon content, we found that excellent formability may be obtained in our steel sheets if it is determined from the shift in the positions of diffraction peaks in X-ray diffraction (XRD), which is a conventional method of measuring an average carbon content in retained austenite (an average of carbon contents in retained austenite), that an average carbon content in the retained austenite is 0.70% or more.

In this case, if an average carbon content in the retained austenite is less than 0.70%, martensite transformation occurs in a low strain range during working, which prevents a TRIP effect from being produced in a high strain range to improve workability. Accordingly, an average carbon content in the retained austenite is 0.70% or more, preferably 0.90% or more. On the other hand, if an average carbon content in the retained austenite exceeds 2.00%, the retained austenite becomes excessively stable, martensite transformation does not occur during working and a TRIP effect fails to occur, which results in a deterioration in ductility. Accordingly, an average carbon content in the retained austenite is preferably 2.00% or less, more preferably 1.50% or less.

<Area Ratio of Bainitic Ferrite in Upper Bainite: 5% or More>

Generation of bainitic ferrite by upper bainite transformation is necessary to allow concentration of carbon in non-transformed austenite to obtain retained austenite that produces a TRIP effect in a high strain range during working to enhance strain dispersibility. Transformation from austenite to bainite occurs over a wide temperature range from about 150 to 550° C. There are various types of bainite generated within this temperature range. Although these different types of bainite are often merely defined as bainite in the conventional art, exact definitions of bainite phases are necessary to achieve our target workability and, therefore, upper bainite and lower bainite phases are defined.

As used herein, upper bainite and lower bainite are defined as follows.

Upper bainite is composed of lath-shaped bainitic ferrite and retained austenite and/or carbides present between bainitic ferrite, and fine carbides regularly arranged in the lath-shaped bainitic ferrite are not present. On the other hand, lower bainite is common to upper bainite, composed of lath-shaped bainitic ferrite and retained austenite and/or carbides present between bainitic ferrite, but, unlike upper bainite, fine carbides regularly arranged in the lath-shaped bainitic ferrite are present.

That is, upper and lower bainite are distinguished on the basis of the presence or absence of fine carbides regularly arranged in the bainitic ferrite. The above-described difference in the generation state of carbides in the bainitic ferrite exerts a significant influence on concentration of carbon in the retained austenite.

If bainitic ferrite in the upper bainite has an area ratio less than 5%, concentration of carbon in austenite does not proceed sufficiently through upper bainite transformation, which results in a reduction in the amount of retained austenite that shows a TRIP effect in a high strain range during working. Therefore, bainitic ferrite in the upper bainite is required to have an area ratio of 5% or more to the entire microstructure of the steel sheet. On the other hand, if the area ratio of bainitic ferrite in the upper bainite exceeds 75%, it may be difficult to ensure sufficient strength. Therefore, the area ratio of bainitic ferrite in the upper bainite is preferably 75% or less, more preferably 65% or less.

<Total of Area Ratio of Martensite, Amount of Retained Austenite and Area Ratio of Bainitic Ferrite in Upper Bainite: 40% or More>

It is not enough to merely set the area ratio of martensite, the amount of retained austenite and the area ratio of bainitic ferrite in the upper bainite to fall within the above-described range, respectively. Rather, it is necessary to set a total of the area ratio of martensite, the amount of retained austenite and the area ratio of bainitic ferrite in the upper bainite to be 40% or more. If the total is less than 40%, there is a disadvantage with insufficient strength or reduced formability, or both. The total is preferably 50% or more, more preferably 60% or more. In addition, the upper limit of the above-described total of area ratio is 90%.

<Area Ratio of Polygonal Ferrite: More than 10% and Less than 50%>

If the area ratio of polygonal ferrite exceeds, 10%, the steel sheet becomes more prone to cracks as strain is concentrated in the soft polygonal ferrite mixed in the hard phase during working and, as a result, desired formability may not be obtained. However, we found that it is possible to avoid degradation in formability by controlling the existence of polygonal ferrite. Specifically, even if polygonal ferrite exists, it is possible to reduce strain concentration and avoid degradation in formability, assuming that it is isolatedly dispersed in the hard phase. However, if the area ratio of polygonal ferrite is 50% or more, it is neither possible to avoid degradation in formability even by controlling the existence thereof, nor to ensure a sufficient strength. In addition, to reduce the area ratio of polygonal ferrite to 10% or less, it is necessary to perform annealing at least a temperature equal to or higher than $A_3$, which poses limitations on facilities. Accordingly, the area ratio of polygonal ferrite is more than 10% and less than 50%, preferably more than 15% and not more than 40%, more preferably more than 15% and not more than 35%.

<Average Grain Size of Polygonal Ferrite: 8 μm or Less, Average Diameter of a Group of Polygonal Ferrite Grains: 15 μm or Less, where the Group of Polygonal Ferrite Grains being Represented by a Group of Ferrite Grains Composed of Adjacent Polygonal Ferrite Grains>

As mentioned earlier, there is a case where desired formability may not be obtained in the event of a multi-phase composed of polygonal ferrite and a hard phase. However, even if polygonal ferrite is present in the hard phase, the polygonal ferrite is in a state where it is isolatedly dispersed in the hard phase, provided that an individual polygonal ferrite grain has an average grain size of 8 μm or less and groups of polygonal ferrite grains have an average diameter of 15 μm or less. Thus, it is possible to reduce strain concentration in the polygonal ferrite and avoid degradation in formability of the steel sheet. As used herein, the term group of polygonal ferrite grains means a microstructure when a group of immediately adjacent ferrite grains is viewed as one grain.

It should be noted that the lower limit of the above-described average grain size of an individual polygonal ferrite grain is about 1 μm, without limitation, in view of the phase generation and growth of polygonal ferrite in the thermal history of annealing of the present invention. In addition, without limitation, the lower limit of the average diameter of the group of polygonal ferrite grains is about 2 μm, in view of the phase generation and growth of polygonal ferrite in the thermal history of annealing.

<Number of Iron-Based Carbides, Each Having a Size of 5 nm or More and 0.5 μm or Less, in Tempered Martensite: $5\times10^4$ or More Per 1 $mm^2$>

If the number of iron-based carbides, each having a size of 5 nm or more and 0.5 μm or less, is less than $5\times10^4$ per 1 $mm^2$, the resulting steel sheet has a tensile strength of 780 MPa or more, but tends to have poor stretch flangeability. The tempered martensite undergoing insufficient auto-tempering, in which the number of iron-based carbides, each having a size of 5 nm or more and 0.5 μm or less, precipitated is less than $5\times10^4$ per 1 $mm^2$, may have inferior workability to that of the sufficiently tempered martensite. Accordingly, with respect to the iron-based carbides in the tempered martensite, the number of iron-based carbides, each having a size of 5 nm or more and 0.5 μm or less, is preferably $5\times10^4$ or more per 1 $mm^2$.

While the above-described iron-based carbides are mainly $Fe_3C$, other carbides such as ϵ carbides may be contained. In addition, those iron-based carbides sized less than 5 nm or more than 0.5 μm are not taken into consideration. This is because such iron-based carbides will make little contribution to the formability of the steel sheet.

It should be noted that the hardness of the hardest phase in the microstructure of the steel sheet is HV≤800. That is, although as-quenched martensite, if present, is the hardest phase in the steel sheet, even as-quenched martensite has a hardness HV≤800 in the steel sheet and there is no martensite having a significantly high hardness HV>800. This ensures good stretch flangeability. Alternatively, if there is no as-quenched martensite and if there are tempered martensite, upper bainite and lower bainite, then any of these phases including lower bainite becomes the hardest phase, but each of these phases has a hardness HV≤800.

The steel sheet may contain pearlite, Widmanstaetten ferrite and lower bainite as the residual phase. In this case, an acceptable content of the residual phase is preferably 20% or less, more preferably 10% or less in area ratio.

Secondly, the reasons for the limitations of the chemical composition of the steel sheet as described above will be described below. Unless otherwise specified, "%" indicates "mass %" as used herein for the elements of the steel sheet and plating layers described below.

<C: 0.10% or More and 0.59% or Less>

C is an element essential to strengthen a steel sheet and ensure a stable amount of retained austenite, and which is necessary to ensure a sufficient amount of martensite and allowing austenite to remain at room temperature. If carbon content is below 0.10%, it is difficult to ensure sufficient strength and formability of the steel sheet. On the other hand, if carbon content is above 0.59%, hardening of a welded zone and a heat-affected zone becomes significant, which deteriorates weldability. Therefore, carbon content is 0.10% or more and 0.59% or less, preferably more than 0.15% to 0.48% or less, more preferably more than 0.15% to 0.40% or less.

<Si: 3.0% or Less (Inclusive of 0%)>

Si is a useful element that contributes to enhancement of the strength of steel by solute strengthening. However, if Si content exceeds 3.0%, an increase in the amount of solute in polygonal ferrite and bainitic ferrite leads to deterioration in formability and toughness, degradation in the surface characteristics due to formation of red scales, and a decrease in cohesiveness and adhesiveness of the coating. Therefore, Si content is 3.0% or less, preferably 2.6% or less, more preferably 2.2% or less, In addition, since Si is an element useful in inhibiting formation of carbides and facilitating formation of retained austenite, Si content is preferably 0.5% or more. However, Si does not have to be added when formation of carbides is inhibited only with Al, in which case Si content may be 0%.

<Mn: 0.5% or More and 3.0% or Less>

Mn is an element effective in strengthening steel. If Mn content is less than 0.5%, carbides are precipitated in the temperature range higher than those provided by bainite and martensite during a cooling process after annealing. Therefore, it is not possible to ensure a sufficient amount of hard phase to contribute to enhancement of the strength of steel. On the other hand, Mn content exceeding 3.0% leads to deterioration in casting performance. Therefore, Mn content is 0.5% or more and 3.0% or less, preferably 1.0% or more to 2.5% or less.

<P: 0.1% or Less>

P is an element useful in strengthening steel. However, P content exceeding 0.1% leads to embrittlement of a steel sheet due to grain boundary segregation, which results in deterioration in impact resistance. P content exceeding 0.1% also leads to a significant decrease in alloying rate when the steel sheet is subjected to galvannealing. Accordingly, P content is 0.1% or less, preferably 0.05% or less. It should be noted that while less P content is preferable, a reduction of P content to less than 0.005% is made at the expense of a significant increase in cost. Therefore, the lower limit of P content is preferably about 0.005%.

<S: 0.07% or Less>

S is an element that produces MnS as inclusions, and which is the cause of degradation in impact resistance and cracks along the metal flow in a welded zone. Thus, it is preferable to reduce S content as much as possible. However, an excessively reduced the S content results in increased manufacturing cost. Therefore, S content is 0.07% or less, preferably 0.05% or less, more preferably 0.01% or less. In addition, since a reduction of S content to less than 0.0005% is made at the expense of a significant increase in manufacturing cost, the lower limit of S content is about 0.0005% from the viewpoint of manufacturing cost.

<Al: 3.0% or Less>

Al is a useful element added as a deoxidizer in the steel manufacturing process. However, Al content exceeding 3.0% produces more inclusions in a steel sheet, which results in deterioration in ductility. Accordingly, Al content is 3.0% or less, preferably 2.0% or less. On the other hand, Al is an element useful in inhibiting formation of carbides and facilitating formation of retained austenite. It is thus preferable that Al content is 0.001% or more, more preferably 0.005% or more. It is assumed that Al content represents the amount of Al contained in the steel sheet after deoxidation.

<N: 0.010% or Less>

N is an element that deteriorates the anti-aging property of steel most significantly. It is thus preferable to minimize the N content. If the N content exceeds 0.010%, the anti-aging property deteriorates significantly. Accordingly, the N content is 0.010% or less. In addition, since a reduction in N content to less than 0.001% is made at the expense of a significant increase in manufacturing cost, the lower limit of N content is about 0.001% from the viewpoint of manufacturing cost.

While the basic elements have been described, it is not sufficient to only satisfy the above-described range of elements. Rather, it is also necessary to satisfy the following relation:

[Si %]+[Al %]=0.7% or more (where [X %] indicates mass % of element X).

As described above, both Si and Al are elements useful to inhibit formation of carbides and facilitate formation of retained austenite. While inhibiting formation of carbides is still effective if Si or Al is contained alone, it is necessary to satisfy the relation of a total of Si content and Al content is 0.7% or more. It is assumed that the Al content in the above formula represents the amount of Al contained in the steel sheet after deoxidation.

Regarding the upper limit of the total of Si and Al content as described above, without limitation, [Si %]+[Al %] may be 5.0% or less, preferably 3.0% or less, for reasons of plating properties and ductility.

In addition to the above-described basic elements, the steel sheet may also contain the following elements as appropriate.

At least one element selected from Cr: 0.05% or more and 5.0% or less, V: 0.005% or more and 1.0% or less, and Mo: 0.005% or more and 0.5% or less Cr, V and Mo are elements that act to inhibit formation of pearlite during cooling from annealing temperature. This effect is obtained by adding 0.05% or more of Cr, 0.005% or more of V and 0.005% or more of Mo, respectively. On the other hand, if Cr content exceeds 5.0%, V content exceeds 1.0% and Mo content exceeds 0.5%, the amount of hard martensite becomes excessive and the resulting steel sheet is provided with higher strength than is required. Accordingly, if Cr, V and Mo are contained, Cr content is 0.05% or more and 5.0% or less, V content is 0.005% or more and 1.0% or less, and Mo content is 0.005% or more and 0.5% or less.

<At Least One Element Selected from Ti: 0.01% or More and 0.1% or Less and Nb: 0.01% or More and 0.1% or Less>

Ti and Nb are elements useful in precipitation strengthening of steel. This effect is obtained by containing each element in an amount of 0.01% or more. On the other hand, if the content of each element exceeds 0.1%, formability and shape fixability deteriorate. Accordingly, if Ti and Nb are contained in the steel sheet, Ti content is 0.01% or more and 0.1% or less and Nb content is 0.01% or more and 0.1% or less.

<B: 0.0003% or More and 0.0050% or Less>

B is an element useful to inhibit polygonal ferrite from being formed and grown from austenite grain boundaries. This effect is obtained by containing B in an amount of 0.0003% or more. On the other hand, if B content exceeds 0.0050%, formability deteriorates. Accordingly, if B is contained in the steel sheet, B content is 0.0003% or more and 0.0050% or less.

<At Least One Element Selected from Ni: 0.05% or More and 2.0% or Less and Cu: 0.05% or More and 2.0% or Less>

Ni and Cu are elements effective in strengthening steel. In addition, Ni and Cu facilitate internal oxidation of surfaces of the steel sheet and thereby improve the adhesion property of the coating when the steel sheet is subjected to hot-dip galvanizing or galvannealing. These effects are obtained by containing each element in an amount of 0.05% or more. On the other hand, if the content of each element exceeds 2.0%, formability of the steel sheet deteriorates. Accordingly, if Ni and Cu are contained in the steel sheet, Ni content is 0.05% or more and 2.0% or less and Cu content is 0.05% or more and 2.0% or less.

<At Least One Element Selected from Ca: 0.001% or More and 0.005% or Less and REM: 0.001% or More and 0.005% or Less>

Ca and REM are elements useful to reduce adverse impact of sulfides on stretch flangeability through spheroidization of sulfides. This effect is obtained by containing each element in an amount of 0.001% or more. On the other hand, if the content of each element exceeds 0.005%, there are more inclusions and so on, thereby causing surface defects, internal defects, for example. Accordingly, if Ca and REM are contained in the steel sheet, Ca content is 0.001% or more and 0.005% or less and REM content is 0.001% or more and 0.005% or less.

The remaining components other than the above are Fe and incidental impurities. However, our steel sheets are not intended to exclude other components that are not described herein, without losing the obtained advantages.

Method of manufacturing a high strength steel sheet will now be described below. A billet is prepared with the preferred chemical composition as described above. Then, in hot rolling the billet, the method comprises: heating the billet to a temperature range preferably from 1000° C. or higher to 1300° C. or lower; then hot rolling the billet with a finisher delivery temperature of at least $Ar_3$ or higher and preferably at a temperature range not higher than 950° C.; cooling the billet at a cooling rate until at least 720° C. of (1/[C %])° C./sec or higher (where [C %] indicates mass % of carbon); and coiling the billet at a temperature range from 200° C. or higher to 720° C. or lower to obtain a hot-rolled steel sheet.

To perform final rolling of the hot rolling in an austenite single phase region, the finisher delivery temperature should be not lower than $Ar_3$. Then, the method performs a cooling step. However, during the cooling step after the finish rolling step, a large amount of polygonal ferrite may be produced. As a result, carbon may be concentrated in the remaining non-transformed austenite, and the desired low temperature transformation phase cannot be obtained in a stable manner during the subsequent finish rolling step, which results in variations in strength in width and longitudinal directions of the steel sheet. This may impair the cold rolling properties of the steel sheet. In addition, non-uniformity is introduced from such microstructures after annealing in a region where polygonal ferrite is generated. Thus, as mentioned earlier, it becomes more difficult for polygonal ferrite to exist in a uniform and isolated manner in a hard phase and, as a result, the desired properties may not be obtained. Such microstructures may be controlled by setting the cooling rate to 720° C. after rolling to (1/[C %])° C./sec or higher.

In this case, since the temperatures up to 720° C. are within such a temperature range where polygonal ferrite shows considerable growth, it is necessary to set an average cooling rate for temperatures up to at least 720° C. after rolling to (1/[C %])° C./sec or higher.

In addition, the coiling temperature is 200° C. or higher and 720° C. or lower, as mentioned above. This is because if the finishing temperature is lower than 200° C., as-quenched martensite is produced in a higher proportion and cracks are formed under excessive rolling load and during rolling. On the other hand, if the finishing temperature is higher than 720° C., crystal grains coarsen excessively and ferrite coexists with the pearlite structure in strips, which results in non-uniform microstructure development after annealing and inferior mechanical properties.

It should be noted that the coiling temperature is particularly preferably 580° C. or higher and 720° C. or lower, or alternatively 360° C. or higher and 550° C. or lower.

The billet may be coiled at a temperature range from 580° C. or higher and 720° C. or lower to allow pearlite to be precipitated in the microstructure of steel after the hot rolling, thereby providing a pearlite-based microstructure of steel. In addition, the billet may also be coiled at a temperature range from 360° C. or higher to 550° C. or lower to allow bainite to be precipitated in the microstructure of steel after the hot rolling, thereby providing a bainite-based microstructure of steel.

As used herein, the above-described pearlite-based microstructure of steel indicates a microstructure where pearlite has the largest fraction in area ratio and occupies 50% or more of the microstructure except polygonal ferrite, while a bainite-based microstructure of steel means a microstructure where bainite has the largest fraction in area ratio and occupies 50% or more of the microstructure except polygonal ferrite.

Under this hot rolling condition, it is possible to reduce the rolling load during cold rolling and allow the polygonal ferrite after annealing to be dispersed from between pearlite colonies to grow through nucleation, which facilitates formation of the desired microstructure.

It should be noted that we can assume a case where a steel sheet is manufactured by a normal process including a series of steps, steelmaking, casting, hot rolling, pickling and cold rolling. However, for example, a steel sheet may also be manufactured by omitting some or all of hot rolling steps by thin slab casting or strip casting. In addition, after pickling, the hot-rolled steel sheet is optionally subjected to cold rolling at a rolling reduction rate within a range of 25% or more and 90% or less to obtain a cold-rolled steel sheet, which is then subjected to the next step. In addition, if sheet thickness precision is not required, the hot-rolled steel sheet may be directly subjected to the next step.

The resulting steel sheet is subjected to annealing for 15 seconds or more and 600 seconds or less in a ferrite-austenite dual phase region or in an austenite single phase region, followed by cooling.

The steel sheet has a low temperature transformation phase as a main phase obtained through transformation from non-transformed austenite such as upper bainite or martensite, and contains a predetermined amount of polygonal ferrite. Although there is no particular limitation on the annealing temperature within the above-described range, an annealing temperature exceeding 1000° C. causes considerable growth of austenite grains, coarsening of the constituent phases due to the subsequent cooling, deterioration in toughness, and so on. Therefore, the annealing temperature is preferably 1000° C. or lower.

In addition, if the annealing time is less than 15 seconds, reverse transformation to austenite may not advance sufficiently or carbides in the steel sheet may not be dissolved sufficiently. On the other hand, if the annealing time is more than 600 seconds, there is a cost increase associated with enormous energy consumption. Accordingly, the annealing time is 15 seconds or more and 600 seconds or less, preferably 60 seconds or more and 500 seconds or less.

It should be noted that to obtain the desired microstructure after cooling, the above-described annealing is preferably performed so that the ferrite fraction becomes 60% or less and the average austenite grain size is 50 μm or less.

In this case, the $A_3$ point can be approximated by:

$$A_3\text{ point (° C.)}=910-203\times[C\,\%]^{1/2}+44.7\times[Si\,\%]-30\times[Mn\,\%]+700\times[P\,\%]+130\times[Al\,\%]-15.2\times[Ni\,\%]-11\times[Cr\,\%]-20\times[Cu\,\%]+31.5\times[Mo\,\%]+104\times[V\,\%]+400\times[Ti\,\%]$$

It should be noted that [X %] indicates mass % of element X contained in the steel sheet.

The cold-rolled steel sheet after annealing is cooled to a first temperature range of (Ms-150° C.) or higher and lower than Ms, where Ms is martensite transformation start temperature, at a cooling rate of 8° C./sec or higher on average. This cooling involves cooling the steel sheet to a temperature lower than the Ms to allow a part of austenite to be transformed to martensite. In this case, if the lower limit of the first temperature range is lower than (Ms-150° C.), most of all the non-transformed austenite transform to martensite at this moment, in which case it is not possible to ensure a sufficient amount of upper bainite (including bainitic ferrite and retained austenite). On the other hand, if the upper limit of the first temperature range is not lower than Ms, it is not possible to ensure the amount of tempered martensite as specified in the present invention. Accordingly, the first temperature range is (Ms-150° C.) or higher and lower than Ms.

If the average cooling rate is lower than 8° C./sec, there is excessive formation and growth of polygonal ferrite, precipitation of pearlite and so on, in which case the desired microstructure of the steel sheet cannot be obtained. Accordingly, the average cooling rate from the annealing temperature to the first temperature range is 8° C./sec or higher, preferably 10° C./sec or higher. The upper limit of the average cooling rate is not limited to a particular value as long as there is no variation in cooling stop temperature. In a general facility, if the average cooling rate exceeds 100° C./sec, there are significant variations in microstructure in a longitudinal direction and a sheet width direction of the steel sheet. Thus, the average cooling rate is preferably 100° C./sec or lower. Therefore, the average cooling rate is preferably within a range of 10° C./sec or higher and 100° C./sec or lower.

While actual measurements are required to be performed by Formaster test or the like to determine the above-described Ms with high precision, the Ms shows a relatively good correlation with M, which is defined by Formula (1) below. This M may be used as the Ms.

$$M(°\,C.)=540-361\times\{[C\,\%]/(1-[\alpha\,\%]/100)\}-6\times[Si\,\%]-40\times[Mn\,\%]+30\times[Al\,\%]-20\times[Cr\,\%]-35\times[V\,\%]-10\times[Mo\,\%]-17\times[Ni\,\%]-10\times[Cu\,\%]\geq 100 \quad (1)$$

where [X %] is mass % of alloy element X and [α %] is the area ratio (%) of polygonal ferrite.

The steel sheet cooled to the above-described first temperature region is then heated to a second temperature range of 350 to 490° C. and retained at the second temperature range for 5 seconds or more and 2000 seconds or less. In the second temperature range, the martensite generated by cooling from annealing temperature to the first temperature range is tempered to allow the non-transformed austenite to be transformed to upper bainite. If the upper limit of the second temperature range is higher than 490° C., carbides precipitate from the non-transformed austenite, in which case the desired microstructure cannot be obtained. On the other hand, if the lower limit of the second temperature range is lower than 350° C., lower bainite rather than upper bainite is formed, which poses a problem that reduces the amount of carbon concentrated in the austenite. Accordingly, the second temperature range is 350° C. or higher and 490° C. or lower, preferably 370° C. or higher and 460° C. or lower.

In addition, if the retention time at the second temperature range is less than 5 seconds, tempering of martensite and upper bainite transformation give inadequate results, in which case the desired microstructure of the steel sheet cannot be obtained. This results in deterioration in formability of the resulting steel sheet. On the other hand, if the retention time at the second temperature range is more than 2000 seconds, the non-transformed austenite, which will become retained austenite in the final microstructure of the steel sheet, decomposes in association with precipitation of carbides and stable retained austenite with concentrated carbon cannot be obtained. As a result, either or both of the desired strength and ductility cannot be obtained. Accordingly, the retention time is 5 seconds or more and 2000 seconds or less, preferably 15 seconds or more and 600 seconds or less, more preferably 40 seconds or more and 400 seconds or less.

It should be noted that in a series of heating steps, the retention temperature does not need to be constant insofar as it falls within the above-mentioned predetermined temperature range. Hence, it may vary within a predetermined temperature range and still achieve our objectives. The same is true of cooling rate. In addition, the steel sheet may be subjected to heat treatment in any facility as long as only the thermal history is satisfied. Further, temper rolling may be applied to the surfaces of the steel sheet to correct the shape or surface treatment such as electroplating may be applied after the heat treatment.

The method of manufacturing a high strength steel sheet may further include hot-dip galvanizing treatment or galvannealing treatment in which alloying treatment is further added to the galvanizing treatment.

The hot-dip galvanizing and galvannealing should be performed on the steel sheet which finished cooling to at least the first temperature range. The above-described galvanizing and galvannealing may be applied to the steel sheet at any of the following timings: during raising the temperature of the steel sheet from the first temperature range to the second temperature range, during retaining the steel sheet at the second temperature range, or after retaining the steel sheet at the second temperature range. However, the conditions of retaining the steel sheet at the second temperature range should satisfy the requirements of the present invention.

It is also desirable that the retention time at the second temperature range is 5 seconds or more and 2000 seconds or less, including the time for galvanizing treatment or galvannealing treatment if applicable. In addition, the hot-dip galvanizing treatment or the galvannealing treatment is preferably performed in a continuous galvanizing line. The retention time at the second temperature is more preferably 1000 seconds or less.

Furthermore, the method of manufacturing a high strength steel sheet may include producing the high strength steel sheet according to the above-described manufacturing method on which the steps up to the heat treatment have been performed and, thereafter, performing another hot-dip galvanizing treatment or, furthermore, another galvannealing treatment.

An example of the method of applying hot-dip galvanizing treatment or galvannealing treatment to a steel sheet will be described below.

The steel sheet is immersed into a molten bath, where the amount of adhesion is adjusted through gas wiping, and so on. It is preferable that the amount of Al dissolved in the molten bath is 0.12% or more and 0.22% or less in the case of the hot-dip galvanizing treatment, or alternatively 0.08% or more and 0.18% or less in the case of the galvannealing treatment.

Regarding the treatment temperature, as for the hot-dip galvanizing treatment, the temperature of the molten bath may be within a normal range of 450° C. or higher and 500° C. or lower and, furthermore, in the case of the galvannealing treatment, the temperature during alloying is preferably 550° C. or lower. If the alloying temperature exceeds 550° C., carbides are precipitated from non-transformed austenite and possibly pearlite is generated, in which case it is not possible to obtain strength or formability or both, and the powdering property of the coating layer deteriorates. On the other hand, if the temperature during alloying is lower than 450° C., alloying may not proceed. Therefore, the alloying temperature is preferably 450° C. or higher.

It is preferable that the coating weight is 20 g/m$^2$ or more and 150 g/m$^2$ or less per side. If the coating weight is less than 20 g/m$^2$, the anti-corrosion property becomes inadequate. On the other hand, if the coating weight is exceeds 150 g/m$^2$, the anti-corrosion effect is saturated, which only results in an increase in cost.

It is preferable that the alloying degree of the coating layer (Fe % (Fe content (in mass %)) is 7% or more and 15% or less. If the alloying degree of the coating layer is less than 7%, there will be non-uniformity in alloying and deterioration in quality of appearance, or a so-called ζ phase will be generated in the coating layer, thereby degrading the sliding characteristics of the steel sheet. On the other hand, if the alloying degree of the coating layer exceeds 15%, there will be a large amount of hard and brittle F phase is formed, thereby degrading the adhesion property of the coating.

By applying the coating process as mentioned above, such a high strength steel sheet may be obtained that has a hot-dip galvanized layer or a galvannealed layer on a surface thereof.

EXAMPLES

Our steel sheets and methods will be further described in detail below with reference to the examples. However, the disclosed examples are not intended as limitations. It is also contemplated that variations of the arrangement fall within the spirit and scope of this disclosure.

(Experiment 1)

Ingots obtained by melting steel samples and having chemical compositions shown in Table 1 were heated to 1200° C., subjected to finish hot rolling at 870° C. which is equal to or higher than $Ar_3$, coiled under the conditions shown in Table 2, and then pickled and subjected to subsequent cold rolling at a rolling reduction rate of 65% to be finished to a cold-rolled steel sheet having a sheet thickness of 1.2 mm. The resulting cold-rolled steel sheets were subjected to heat treatment under the conditions shown in Table 2, where the steel sheets were annealed in a ferrite-austenite dual phase region or in an austenite single phase region. It should be noted that the cooling stop temperature: T in Table 2 refers to a temperature at which cooling of a steel sheet is stopped in the course of cooling the steel sheet from the annealing temperature.

In addition, some of the cold-rolled steel sheets were subjected to hot-dip galvannealing treatment (see Sample No. 15). As for the hot-dip galvanizing treatment, a coating was applied on both surfaces at a molten bath temperature of 463° C. so that the coating weight (per side) was 50 g/m$^2$. Likewise, as for the galvannealing treatment, a coating was also applied on both surfaces at a molten bath temperature of 463° C. so that the coating weight (per side) was 50 g/m$^2$, while adjusting the alloying condition at an alloying temperature of 550° C. or lower so that the alloying degree (Fe % (Fe content)) was 9%. It should be noted that the hot-dip galvanizing treatment and the galvannealing treatment were conducted after each steel sheet was cooled to T° C. as shown in Table 2.

The resulting steel sheets were subjected to temper rolling at a elongation ratio of 0.3% after heat treatment if coating treatment was not conducted, or after hot-dip galvanizing treatment or galvannealing treatment if conducted.

TABLE 1

| Steel Type | Chemical Composition of Steel Sheet (mass %) | | | | | | | | | |
|---|---|---|---|---|---|---|---|---|---|---|
| | C | Si | Mn | Al | P | S | N | Cr | V | Mo |
| A | 0.15 | 1.51 | 2.3 | 0.042 | 0.044 | 0.0019 | 0.0029 | — | — | — |
| B | 0.19 | 1.78 | 1.5 | 0.036 | 0.013 | 0.0020 | 0.0029 | — | — | — |
| C | 0.20 | 1.43 | 2.2 | 0.044 | 0.015 | 0.0020 | 0.0029 | — | — | — |
| D | 0.29 | 1.92 | 1.4 | 0.320 | 0.015 | 0.0018 | 0.0029 | — | — | — |
| E | 0.08 | 1.46 | 2.0 | 0.036 | 0.018 | 0.0025 | 0.0041 | — | — | — |
| F | 0.30 | 1.49 | 2.3 | 0.040 | 0.040 | 0.0028 | 0.0042 | — | — | — |
| G | 0.45 | 1.95 | 1.5 | 0.041 | 0.006 | 0.0015 | 0.0036 | — | — | — |
| H | 0.31 | 1.51 | 2.4 | 0.041 | 0.015 | 0.0024 | 0.0042 | — | — | — |
| I | 0.28 | 0.51 | 2.3 | 1.0 | 0.012 | 0.0020 | 0.0025 | — | — | — |
| J | 0.15 | 1.53 | 2.2 | 0.042 | 0.011 | 0.0019 | 0.0038 | — | — | — |
| K | 0.12 | 1.04 | 2.3 | 0.040 | 0.022 | 0.0030 | 0.0041 | — | 0.12 | — |
| L | 0.17 | 1.42 | 2.2 | 0.043 | 0.030 | 0.0030 | 0.0023 | 0.5 | — | — |
| M | 0.15 | 1.28 | 2.8 | 0.044 | 0.020 | 0.0020 | 0.0029 | — | — | — |
| N | 0.30 | 1.48 | 2.0 | 0.044 | 0.015 | 0.0020 | 0.0029 | — | — | 0.20 |
| O | 0.23 | 1.49 | 1.2 | 0.044 | 0.044 | 0.0020 | 0.0029 | — | — | — |
| P | 0.31 | 0.51 | 2.1 | 0.045 | 0.006 | 0.0019 | 0.0034 | — | — | — |
| Q | 0.28 | 0.89 | 0.4 | 0.042 | 0.024 | 0.0018 | 0.0037 | — | — | — |

| Steel Type | Chemical Composition of Steel Sheet (mass %) | | | | | | | | |
|---|---|---|---|---|---|---|---|---|---|
| | Ti | Nb | B | Ni | Cu | Ca | REM | Si + Al | Remarks |
| A | — | — | — | — | — | — | — | 1.55 | Conforming Steel |
| B | — | — | — | — | — | — | — | 1.82 | Conforming Steel |
| C | — | — | — | — | — | — | — | 1.47 | Conforming Steel |
| D | — | — | — | — | — | — | — | 2.24 | Conforming Steel |
| E | — | — | — | — | — | — | — | 1.50 | Comparative Steel |
| F | — | — | — | — | — | — | — | 1.53 | Conforming Steel |
| G | — | — | — | — | — | — | — | 1.99 | Conforming Steel |
| H | — | — | — | — | — | 0.002 | — | 1.55 | Conforming Steel |
| I | — | — | — | — | — | — | 0.002 | 1.51 | Conforming Steel |
| J | — | 0.04 | — | — | — | — | — | 1.57 | Conforming Steel |
| K | 0.021 | — | 0.0012 | — | — | — | — | 1.08 | Conforming Steel |
| L | 0.025 | — | 0.0010 | — | — | — | — | 1.46 | Conforming Steel |
| M | 0.023 | — | 0.0015 | — | — | — | — | 1.32 | Conforming Steel |
| N | — | — | — | — | — | — | — | 1.52 | Conforming Steel |
| O | — | — | — | 0.29 | 0.32 | — | — | 1.53 | Conforming Steel |
| P | — | — | — | — | — | — | — | 0.56 | Comparative Steel |
| Q | — | — | — | — | — | — | — | 0.93 | Comparative Steel |

| Sample No. | Steel Type | Coating Type* | 1/[C %] ° C./sec | Cooling Rate Until 720° C. ° C./sec | Coiling Temp. ° C. | Annealing Temp. ° C. | Annealing Time sec | Ave. Cooling Rate Until First Temp. Range ° C./sec |
|---|---|---|---|---|---|---|---|---|
| 1 | A | CR | 6.7 | 35 | 450 | 830 | 180 | 15 |
| 2 | B | CR | 5.3 | 15 | 600 | 810 | 180 | 9 |
| 3 | C | CR | 5.0 | 20 | 500 | 840 | 180 | 10 |
| 4 | C | CR | 5.0 | 20 | 510 | 960 | 320 | 3 |
| 5 | C | CR | 5.0 | 30 | 480 | 820 | 250 | 10 |
| 6 | D | CR | 3.4 | 20 | 610 | 820 | 180 | 8 |
| 7 | E | CR | 12.5 | 30 | 620 | 850 | 200 | 35 |
| 8 | F | CR | 3.3 | 20 | 610 | 800 | 180 | 15 |
| 9 | F | CR | 3.3 | 20 | 600 | 800 | 180 | 10 |
| 10 | F | CR | 3.3 | 20 | 650 | 800 | 200 | 12 |
| 11 | F | CR | 3.3 | 20 | 600 | 880 | 250 | 8 |
| 12 | G | CR | 2.2 | 25 | 710 | 800 | 400 | 9 |
| 13 | G | CR | 2.2 | 20 | 600 | 820 | 400 | 10 |
| 14 | H | CR | 3.2 | 20 | 600 | 800 | 180 | 25 |
| 15 | I | GA | 3.6 | 25 | 600 | 800 | 180 | 10 |
| 16 | J | CR | 6.7 | 20 | 600 | 850 | 180 | 30 |
| 17 | K | CR | 8.3 | 30 | 479 | 820 | 200 | 20 |
| 18 | L | CR | 5.9 | 25 | 500 | 820 | 250 | 10 |
| 19 | M | CR | 6.7 | 20 | 530 | 820 | 250 | 15 |
| 20 | N | CR | 3.3 | 20 | 610 | 780 | 500 | 10 |
| 21 | O | CR | 4.3 | 20 | 620 | 790 | 250 | 8 |
| 22 | P | CR | 3.2 | 20 | 610 | 800 | 250 | 15 |
| 23 | Q | CR | 3.0 | 20 | 600 | 830 | 300 | 10 |

-continued

| Sample No. | Cooling Stop Temp.: T ° C. | Holding Temp. at Second Temp. Range ° C. | Holding Time at Second Temp. Range sec | Ms ° C. | Ms - 150° C. ° C. | Temp. Difference between Cooling Stop Temp. and Ms Point ° C. | Remarks |
|---|---|---|---|---|---|---|---|
| 1 | 330 | 400 | 120 | 378 | 228 | 48 | Inventive Example |
| 2 | 245 | 420 | 60 | 338 | 188 | 93 | Inventive Example |
| 3 | 280 | 390 | 100 | 364 | 214 | 84 | Inventive Example |
| 4 | 240 | 400 | 520 | 284 | 134 | 44 | Comparative Example |
| 5 | 400 | 400 | 300 | 334 | 184 | −66 | Comparative Example |
| 6 | 200 | 410 | 90 | 305 | 155 | 105 | Inventive Example |
| 7 | 360 | 420 | 300 | 405 | 255 | 45 | Comparative Example |
| 8 | 240 | 380 | 300 | 308 | 158 | 68 | Inventive Example |
| 9 | 210 | 400 | 300 | 310 | 160 | 100 | Inventive Example |
| 10 | 210 | 580 | 250 | 310 | 160 | 100 | Comparative Example |
| 11 | 85 | 400 | 200 | 288 | 138 | 203 | Comparative Example |
| 12 | 250 | 420 | 550 | 287 | 137 | 37 | Inventive Example |
| 13 | 270 | 400 | 3 | 287 | 137 | 17 | Comparative Example |
| 14 | 220 | 390 | 300 | 301 | 151 | 81 | Inventive Example |
| 15 | 250 | 400 | 300 | 352 | 202 | 102 | Inventive Example |
| 16 | 270 | 420 | 90 | 338 | 188 | 68 | Inventive Example |
| 17 | 250 | 400 | 200 | 357 | 207 | 107 | Inventive Example |
| 18 | 250 | 450 | 100 | 346 | 196 | 96 | Inventive Example |
| 19 | 245 | 420 | 100 | 353 | 203 | 108 | Inventive Example |
| 20 | 200 | 350 | 300 | 329 | 179 | 129 | Inventive Example |
| 21 | 300 | 420 | 450 | 376 | 226 | 76 | Inventive Example |
| 22 | 270 | 400 | 120 | 324 | 174 | 54 | Comparative Example |
| 23 | 140 | 400 | 60 | 159 | 9 | 19 | Comparative Example |

The steel sheets thus obtained were evaluated for their properties by the following method. A sample was cut from each steel sheet and polished. The microstructure of a surface parallel to the rolling direction was observed in ten fields of view with a scanning electron microscope (SEM) at 3000× magnification to measure the area ratio of each phase and identify the phase structure of each crystal grain.

The steel sheet was ground and polished to one-quarter of the sheet thickness in the sheet thickness direction to determine the amount of retained austenite by X-ray diffractometry. Using Co—Kα as an incident X-ray, the amount of retained austenite was calculated from the intensity ratio of each of (200), (220) and (311) planes of austenite to the diffraction intensity of each of (200), (211) and (220) planes of ferrite.

As for the average carbon content in the retained austenite, a lattice constant was calculated from the intensity peak of each of (200), (220) and (311) planes of austenite obtained by the X-ray diffractometry, and the average carbon content (%) in the retained austenite was determined by the following formula:

$$a_0=0.3580+0.0033\times[C\ \%]+0.00095\times[Mn\ \%]+0.0056\times[Al\ \%]+0.022\times[N\ \%]$$

where $a_0$ indicates a lattice constant (nm) and [X %] indicates mass % of element X. It was assumed that the percentage of elements other than C is the percentage relative to the entire steel sheet.

The tensile test was conducted in accordance with JIS Z2241 by using a JIS No. 5 tensile test specimen taken in a direction perpendicular to the rolling direction of the steel sheet. TS (tensile strength) and T.EL (total elongation) were measured and a product of tensile strength and total elongation (TS×T.EL) was calculated to evaluate the balance between strength and workability (ductility). It should be noted that cases where TS×T.EL 27000 (MPa·%) were evaluated satisfactory.

Stretch-flangeability was evaluated under the Japan Iron and Steel Federation Standard JFST 1001. Each of the resulting steel sheets was cut into 100 mm×100 mm, where a hole having a diameter of 10 mm was punched with a clearance of 12% of sheet thickness. Then, a dice having an inside diameter of 75 mm was used to measure the diameter of the hole at crack initiation limit by pushing a 60° conical punch into the hole and holding it under a blank holding force of 88.2 kN, and hole-expansion limit λ (%) was determined by the following Formula (1):

$$\lambda\ (\%)=\{(D_f-D_0)/D_0\}\times 100, \quad (1)$$

where $D_f$ represents a hole diameter (mm) at the time of crack occurrence and $D_0$ represents an initial hole diameter (mm). Stretch flangeability was evaluated as satisfactory if λ≥25 (%).

In addition, the hardness of the hardest phase in the steel sheet microstructure was determined by the following method. That is, as a result of the microstructure observation, in the case where as-quenched martensite was observed, measurements were performed on ten points of the as-quenched martensite with Ultra Micro-Vickers Hardness Tester under a load of 0.02 N, and an average value thereof was assumed as the hardness of the hardest microstructure in the steel sheet microstructure. It should be noted that if as-quenched martensite is not observed, as mentioned earlier, any of the tempered martensite, upper bainite or lower bainite phase becomes the hardest phase in our steel sheets. In the case of our steel sheets, a phase with HV≤800 was the hardest phase. Further, for each test specimen that was cut from each steel sheet, iron-based carbides, each having a size of 5 nm or more and 0.5 μm or less in the tempered martensite, was observed with SEM at 10000× to 30000× magnification to determine the number of precipitates.

The above-described evaluation results are shown in Table 3.

It should be noted that regarding the fraction of steel microstructure in Table 3, bainitic ferrite in upper bainite (αb), martensite (M), tempered martensite (tM) and polygonal ferrite (α) each represents an area ratio relative to the entire microstructure of the steel sheet, while retained austenite (γ) represents the amount of retained austenite determined as described above.

TABLE 3

| Sample No. | Steel Type | Fraction of Steel Microstructure (%)* αb | M | tM | α | γ | Balance | αb + M + γ | tM/M % | Carbon Content in Retained γ % |
|---|---|---|---|---|---|---|---|---|---|---|
| 1 | A | 70 | 10 | 8 | 13 | 7 | 0 | 87 | 80 | 0.99 |
| 2 | B | 29 | 13 | 9 | 48 | 9 | 1 | 51 | 69 | 1.02 |
| 3 | C | 63 | 14 | 10 | 11 | 12 | 0 | 89 | 71 | 0.91 |
| 4 | C | 15 | 21 | 19 | 55 | 6 | 3 | 42 | 90 | 1.05 |
| 5 | C | 41 | 12 | 2 | 35 | 12 | 0 | 65 | 17 | 0.91 |
| 6 | D | 32 | 15 | 11 | 41 | 10 | 2 | 57 | 73 | 0.93 |
| 7 | E | 34 | 18 | 18 | 40 | 8 | 0 | 60 | 100 | 0.92 |
| 8 | F | 45 | 25 | 21 | 18 | 12 | 0 | 82 | 84 | 0.79 |
| 9 | F | 53 | 18 | 13 | 17 | 12 | 0 | 83 | 72 | 1.05 |
| 10 | F | 22 | 16 | 14 | 15 | 3 | 44 | 41 | 88 | 1.08 |
| 11 | F | 5 | 64 | 63 | 29 | 2 | 0 | 71 | 98 | 0.90 |
| 12 | G | 28 | 42 | 40 | 12 | 15 | 3 | 85 | 95 | 1.21 |
| 13 | G | 7 | 74 | 15 | 12 | 7 | 0 | 88 | 20 | 0.77 |
| 14 | H | 53 | 15 | 13 | 17 | 15 | 0 | 83 | 87 | 0.85 |
| 15 | I | 45 | 25 | 21 | 18 | 12 | 0 | 82 | 84 | 0.96 |
| 16 | J | 30 | 13 | 8 | 49 | 8 | 0 | 51 | 62 | 0.99 |
| 17 | K | 20 | 21 | 19 | 47 | 10 | 2 | 51 | 90 | 0.97 |
| 18 | L | 25 | 29 | 20 | 31 | 15 | 0 | 69 | 69 | 0.88 |
| 19 | M | 30 | 32 | 28 | 21 | 17 | 0 | 79 | 88 | 0.84 |
| 20 | N | 10 | 69 | 65 | 11 | 10 | 0 | 89 | 94 | 0.93 |
| 21 | O | 52 | 16 | 14 | 19 | 13 | 0 | 81 | 88 | 0.85 |
| 22 | P | 38 | 45 | 28 | 14 | 3 | 0 | 86 | 62 | 0.88 |
| 23 | Q | 5 | 0 | 0 | 72 | 0 | 23 | 5 | — | — |

| Sample No. | Size of α Grain μm | Size of Group of α Grains μm | Iron-based Carbides in tM #/mm$^2$ | TS MPa | T.EL % | λ % | TS × T.EL MPa × % | Remarks |
|---|---|---|---|---|---|---|---|---|
| 1 | 3.2 | 4.3 | $1 \times 10^5$ | 1009 | 27 | 33 | 27243 | Inventive Example |
| 2 | 6.3 | 11.2 | $7 \times 10^5$ | 813 | 35 | 38 | 28455 | Inventive Example |
| 3 | 2.4 | 4.0 | $2 \times 10^6$ | 1175 | 24 | 35 | 28200 | Inventive Example |
| 4 | 10.3 | 22.2 | $8 \times 10^5$ | 742 | 31 | 32 | 23002 | Comparative Example |
| 5 | 4.1 | 5.8 | $2 \times 10^6$ | 1021 | 24 | 13 | 24504 | Comparative Example |
| 6 | 4.6 | 6.3 | $5 \times 10^5$ | 923 | 32 | 27 | 29536 | Inventive Example |
| 7 | 7.0 | 12.5 | $2 \times 10^6$ | 698 | 30 | 52 | 20940 | Comparative Example |
| 8 | 2.6 | 4.3 | $4 \times 10^5$ | 1246 | 23 | 26 | 28658 | Inventive Example |
| 9 | 3.4 | 5.1 | $2 \times 10^6$ | 1311 | 21 | 27 | 27531 | Inventive Example |
| 10 | 3.5 | 5.1 | $3 \times 10^6$ | 1023 | 16 | 32 | 16368 | Comparative Example |
| 11 | 5.0 | 6.3 | $3 \times 10^6$ | 1296 | 15 | 26 | 19440 | Comparative Example |
| 12 | 2.0 | 2.9 | $4 \times 10^6$ | 1375 | 23 | 28 | 31625 | Inventive Example |
| 13 | 2.3 | 3.4 | $1 \times 10^3$ | 1927 | 8 | 0 | 15416 | Comparative Example |
| 14 | 3.1 | 5.4 | $3 \times 10^6$ | 1336 | 23 | 25 | 30728 | Inventive Example |
| 15 | 3.8 | 4.9 | $5 \times 10^5$ | 1214 | 23 | 27 | 27922 | Inventive Example |
| 16 | 7.2 | 13.4 | $2 \times 10^6$ | 1012 | 27 | 35 | 27324 | Inventive Example |
| 17 | 5.8 | 8.0 | $2 \times 10^6$ | 1125 | 26 | 32 | 29250 | Inventive Example |
| 18 | 4.9 | 6.2 | $8 \times 10^5$ | 1243 | 26 | 31 | 32318 | Inventive Example |
| 19 | 2.9 | 3.9 | $2 \times 10^6$ | 1185 | 28 | 28 | 33180 | Inventive Example |
| 20 | 2.1 | 4.1 | $3 \times 10^6$ | 1393 | 20 | 26 | 27860 | Inventive Example |
| 21 | 3.0 | 4.8 | $1 \times 10^5$ | 1322 | 22 | 31 | 29084 | Inventive Example |
| 22 | 2.2 | 4.5 | $4 \times 10^6$ | 1286 | 12 | 26 | 15432 | Comparative Example |
| 23 | 5.0 | 16.2 | — | 765 | 23 | 27 | 17595 | Comparative Example |

*αb: bainitic ferrite in upper bainite,
M: martensite,
tM: tempered martensite,
α: polygonal ferrite,
γ: retained austenite As apparent from Table 3, it was ascertained that all of the examples of our steel sheets satisfy the conditions that tensile strength is 780 MPa or more, the value of TS×T.EL is 27000 MPa·% or more and the value of λ is 25% or more, and thus has both high strength and excellent formability.

In contrast, Sample No. 4 failed to provide a desired microstructure of the steel sheet because its average cooling rate until the first temperature range was out of our range, where the tensile strength (TS) of Sample No. 4 did not reach 780 MPa and the value of TS×T.EL was less than 27000 MPa·%, although Sample No. 4 satisfied the condition of the value of λ being 25% or more and offered sufficient stretch flangeability.

Sample Nos. 5 and 11 failed to provide a desired microstructure of the steel sheet because the cooling stop temperature: T was outside the first temperature range, and failed to satisfy either of the conditions: the value of TS×T.EL being 27000 MPa·% or more, or the value of λ being 25% or more, although satisfying the condition of tensile strength (TS) being 780 MPa or more.

Sample No. 7 failed to provide a desired microstructure of the steel sheet because the chemical composition of carbon was out of our range and failed to satisfy both of the conditions: the value of tensile strength (TS) being 780 MPa or more and the value of TS×T.EL being 27000 MPa·% or more.

Sample No. 10 failed to provide a desired microstructure of the steel sheet because the retention temperature at the second temperature range was out of our range and failed to satisfy our criteria because the value of TS×T.EL was less than 27000 MPa·%, although ensuring sufficient tensile strength (TS) and stretch flangeability.

Sample No. 13 failed to provide a desired microstructure of the steel sheet because the retention time at the second temperature range was out of our range and failed to satisfy both of the conditions: the value of TS×T.EL being 27000 MPa·% or more and the value of λ being 25% or more, although satisfying the condition of the value of tensile strength (TS) being 780 MPa or more.

Sample No. 22 failed to provide a desired microstructure of the steel sheet because the total of Si content and Al content was out of our range and failed to satisfy our criteria because the value of TS×T.EL was less than 27000 MPa·%, although ensuring sufficient tensile strength (TS) and stretch flangeability.

Sample No. 23 failed to provide a desired microstructure of the steel sheet because Mn content was out of our range, where the tensile strength (TS) of Sample No. 23 did not reach 780 MPa and the value of TS×T.EL was less than 27000 MPa·%, although Sample No. 23 ensured sufficient stretch flangeability.

The invention claimed is:

1. A high strength steel sheet comprising a chemical composition including, in mass %, C: 0.10% or more and 0.59% or less, Si: 3.0% or less, Mn: 0.5% or more and 3.0% or less, P: 0.1% or less, S: 0.07% or less, Al: 3.0% or less, N: 0.010% or less, and the balance being Fe and incidental impurities, wherein a relation [Si %]+[Al %]=0.7% or more is satisfied (where [X %] indicates mass % of element X), wherein the steel sheet has a microstructure such that:

martensite has an area ratio of 5% or more and 70% or less to the entire microstructure of the steel sheet, retained austenite is contained in an amount of 5% or more and 40% or less, and bainitic ferrite in upper bainite has an area ratio of 5% or more to the entire microstructure of the steel sheet, where a total of the area ratio of the martensite, the amount of the retained austenite and the area ratio of the bainitic ferrite is 40% or more, 25% or more of the martensite is tempered martensite, polygonal ferrite has an area ratio of more than 10% and less than 50% to the entire microstructure of the steel sheet and an average grain size of 8 μm or less, and an average diameter of a group of polygonal ferrite grains is 15 μm or less, where the group of polygonal ferrite grains is represented by a group of ferrite grains composed of adjacent polygonal ferrite grains, an average carbon content in the retained austenite is 0.70 mass % or more, and the steel sheet has a tensile strength of 780 MPa or more.

2. The high strength steel sheet according to claim 1, wherein the steel sheet further comprises at least one group selected from (A) to (E), wherein:

(A) in mass %, at least one element selected from

Cr: 0.05% or more and 5.0% or less,

V: 0.005% or more and 1.0% or less, and

Mo: 0.005% or more and 0.5% or less, (B) in mass %, at least one element selected from Ti: 0.01% or more and 0.1% or less, and Nb: 0.01% or more and 0.1% or less, (C) in mass %, B: 0.0003% or more and 0.0050% or less (D) in mass %, at least one element selected from Ni: 0.05% or more and 2.0% or less, and Cu: 0.05% or more and 2.0% or less, (E) in mass %, at least one element selected from Ca: 0.001% or more and 0.005% or less, and REM: 0.001% or more and 0.005% or less.

3. The high strength steel sheet according to claim 1, wherein the number of iron-based carbides, each having a size of 5 nm or more and 0.5 μm or less, precipitated in the tempered martensite is $5\times10^4$ or more per 1 $mm^2$.

4. The high strength steel sheet according to claim 2, wherein the number of iron-based carbides, each having a size of 5 nm or more and 0.5 μm or less, precipitated in the tempered martensite is $5\times10^4$ or more per 1 $mm^2$.

5. The high strength steel sheet according to claim 1, further comprising a hot-dip galvanized layer or a galvannealed layer on a surface thereof.

6. The high strength steel sheet according to claim 2, further comprising a hot-dip galvanized layer or a galvannealed layer on a surface thereof.

7. The high strength steel sheet according to claim 3, further comprising a hot-dip galvanized layer or a galvannealed layer on a surface thereof.

8. The high strength steel sheet according to claim 4, further comprising a hot-dip galvanized layer or a galvannealed layer on a surface thereof.

9. A method of manufacturing a high strength steel sheet comprising:

in hot rolling a billet with the chemical composition as recited in claim 1, finishing the hot rolling of the billet when a finisher delivery temperature reaches $Ar_3$ or higher;

cooling the billet at a cooling rate until at least 720° C. of (1/[C %])° C./sec or higher (where [C %] indicates mass % of carbon);

coiling the billet at a coiling temperature of 200° C. or higher and 720° C. or lower to obtain a hot-rolled steel sheet;

directly after the coiling, or optionally, after cold rolling the hot-rolled steel sheet to obtain a cold-rolled steel sheet, subjecting the hot-rolled steel sheet or the cold-rolled steel sheet to annealing for 15 seconds or more and 600 seconds or less in a ferrite-austenite dual phase region or in an austenite single phase region;

cooling the steel sheet to a first temperature range of (Ms-150° C.) or higher to lower than Ms, where Ms is martensite transformation start temperature, at an average cooling rate of 8° C./sec or higher;

heating the steel sheet to a second temperature range of 350° C. or higher to 490° C. or lower; and retaining the steel sheet in the second temperature range for 5 seconds or more to 2000 seconds or less.

10. A method of manufacturing a high strength steel sheet comprising:

in hot rolling a billet with the chemical composition as recited in claim 2, finishing the hot rolling of the billet when a finisher delivery temperature reaches $Ar_3$ or higher;

cooling the billet at a cooling rate until at least 720° C. of (1/[C %])° C./sec or higher (where [C %] indicates mass % of carbon);

coiling the billet at a coiling temperature of 200° C. or higher and 720° C. or lower to obtain a hot-rolled steel sheet;

directly after the coiling, or optionally, after cold rolling the hot-rolled steel sheet to obtain a cold-rolled steel sheet, subjecting the hot-rolled steel sheet or the cold-rolled steel sheet to annealing for 15 seconds or more and 600 seconds or less in a ferrite-austenite dual phase region or in an austenite single phase region;

cooling the steel sheet to a first temperature range of (Ms-150° C.) or higher to lower than Ms, where Ms is martensite transformation start temperature, at an average cooling rate of 8° C./sec or higher;

heating the steel sheet to a second temperature range of 350° C. or higher to 490° C. or lower; and retaining the steel sheet in the second temperature range for 5 seconds or more to 2000 seconds or less.

11. The method according to claim 9, wherein the coiling temperature is 580° C. or higher and 720° C. or lower.

12. The method according to claim 10, wherein the coiling temperature is 580° C. or higher and 720° C. or lower.

13. The method according to claim 9, wherein the coiling temperature is 360° C. or higher and 550° C. or lower.

14. The method according to claim 10, wherein the coiling temperature is 360° C. or higher and 550° C. or lower.

15. The method according to claim 9, wherein, after completion of cooling the steel sheet to at least the first temperature range, the steel sheet is subjected to a hot-dip galvanizing or galvannealing process.

16. The method according to claim 10, wherein, after completion of cooling the steel sheet to at least the first temperature range, the steel sheet is subjected to a hot-dip galvanizing or galvannealing process.

17. The method according to claim 11, wherein, after completion of cooling the steel sheet to at least the first temperature range, the steel sheet is subjected to a hot-dip galvanizing or galvannealing process.

18. The method according to claim 12, wherein, after completion of cooling the steel sheet to at least the first temperature range, the steel sheet is subjected to a hot-dip galvanizing or galvannealing process.

19. The method according to claim 13, wherein after completion of cooling the steel sheet to at least the first temperature range, the steel sheet is subjected to a hot-dip galvanizing or galvannealing process.

20. The method according to claim 14, wherein, after completion of cooling the steel sheet to at least the first temperature range, the steel sheet is subjected to a hot-dip galvanizing or galvannealing process.

* * * * *

UNITED STATES PATENT AND TRADEMARK OFFICE

CERTIFICATE OF CORRECTION

PATENT NO. : 8,876,987 B2
APPLICATION NO. : 14/349234
DATED : November 4, 2014
INVENTOR(S) : Matsuda et al.

It is certified that error appears in the above-identified patent and that said Letters Patent is hereby corrected as shown below:

In the Specification

In Column 16

At line 19, please change “F phase” to -- Γ phase --.

Signed and Sealed this
Twenty-third Day of June, 2015

Michelle K. Lee

Michelle K. Lee
*Director of the United States Patent and Trademark Office*